US009635913B1

(12) United States Patent
Chen

(10) Patent No.: US 9,635,913 B1
(45) Date of Patent: May 2, 2017

(54) UMBRELLA WITH ADJUSTABLE COVERAGE ADAPTED TO BACKPACK

(71) Applicant: Li-Chiu Chen, Taipei (TW)

(72) Inventor: Li-Chiu Chen, Taipei (TW)

( * ) Notice: Subject to any disclaimer, the term of this patent is extended or adjusted under 35 U.S.C. 154(b) by 0 days.

(21) Appl. No.: 15/256,574

(22) Filed: Sep. 4, 2016

(51) Int. Cl.

| | |
|---|---|
| ***A45B 3/00*** | (2006.01) |
| ***A45B 25/18*** | (2006.01) |
| ***A45B 11/00*** | (2006.01) |
| ***A45B 25/02*** | (2006.01) |
| ***A45F 3/04*** | (2006.01) |
| *A45F 3/00* | (2006.01) |

(52) U.S. Cl.
CPC ..... *A45B 3/00* (2013.01); *A45B 11/00* (2013.01); *A45B 25/02* (2013.01); *A45B 25/18* (2013.01); *A45F 3/04* (2013.01); *A45F 2003/001* (2013.01)

(58) Field of Classification Search
CPC A45B 3/00; A45B 23/00; A45B 11/00; A45B 25/02; A45B 17/00; A45B 2200/1009; A45F 2003/003; A45F 3/04
USPC ..... 135/16, 20.1, 29, 33.2, 96, 98, 147; 224/186–190, 154, 576; 297/184.16–184.17
See application file for complete search history.

(56) References Cited

U.S. PATENT DOCUMENTS 554,792 A * 2/1896 Pittenger et al. ..... E04H 15/06 135/140
3,840,161 A * 10/1974 Boggs ..... A47D 13/025 224/161
4,112,957 A * 9/1978 Biven ..... A45B 11/00 135/87
4,179,053 A * 12/1979 Figura ..... A45F 3/08 135/120.3
5,263,837 A * 11/1993 Dompe ..... A45B 11/02 224/190
5,318,055 A * 6/1994 Olaniyan ..... A45B 11/02 135/16
5,695,100 A * 12/1997 O'Brien ..... A47C 7/66 135/143
6,076,539 A * 6/2000 Richardson ..... A45F 3/04 135/120.3
6,422,252 B1 * 7/2002 Pilz ..... A45B 17/00 135/20.1
8,851,343 B1 * 10/2014 Evans ..... A45B 11/02 135/20.1
2007/0262103 A1 * 11/2007 Blakley ..... A45B 11/02 224/190

(Continued)

*Primary Examiner* — Winnie Yip

(57) ABSTRACT

An umbrella comprises a cover and two rod hinges. A canopy is engaged with a rectangular frame for forming a rectangular cover. A left rainproof folding fan and a right rainproof folding fan, each has a pivot at a bottom linked with the bearings of the rectangular frame, respectively. Two sets of Velcro is linked with the rectangular cover, the left rainproof folding fan and the right rainproof folding fan for forming the cover. The two rod hinges is linked with the rectangular frame and attached onto two straps of a backpack through two fasteners, the each rod hinge having a bracket and a rod with a stopper and an outlet connected with the each pin respectively, wherein the cover and the two rod hinges form an umbrella with adjustable coverage which has the rectangular frame fixed with the stoppers when the cover is extended and the two rod hinges are extended and erected.

10 Claims, 7 Drawing Sheets

(56) References Cited

U.S. PATENT DOCUMENTS

| | | | | |
|---|---|---|---|---|
| 2008/0018146 | A1* | 1/2008 | Wahl | A47C 7/66<br>297/184.15 |
| 2013/0098410 | A1* | 4/2013 | Prasannakumar | A45B 11/00<br>135/16 |

* cited by examiner

UMBRELLA WITH ADJUSTABLE COVERAGE ADAPTED TO BACKPACK

BACKGROUND OF THE INVENTION

Field of the Invention

The present invention relates to an umbrella, particularly to an umbrella that can be supported by a backpack, and more particularly to an umbrella with adjustable coverage adapted to backpack.

Description of the Prior Art

As well known to those skilled in the art, shapes of umbrellas or an umbrella adapted to backpack are center outward radial. The traditional umbrella limited to its shape is hard to shield the both shoulders of the body. Moreover, a coverage of the traditional umbrellas is not adjustable in respond to various weather conditions. The traditional umbrellas adapted to backpack are hands-free. However, structures of the traditional umbrellas adapted to backpack are complicated and difficult to use. Consequently, users do not want to carry the traditional umbrellas adapted to backpack.

SUMMARY OF THE INVENTION

An objective of the present invention is to solve the above-mentioned problems and to provide an umbrella with adjustable coverage adapted to backpack, which can be fixed on the backpack without then holding umbrella. Ergonomically, both sides of the umbrella with a large coverage can shield the both shoulders of the body.

The present invention achieves the above-indicated objective by providing an umbrella with adjustable coverage adapted to backpack. The umbrella comprises a cover and two rod hinges. The cover includes a rectangular frame with a left side and a right side, wherein the left side and the right side each comprises a pin and a bearing respectively. A canopy is engaged with the rectangular frame for forming a rectangular cover. A left rainproof folding fan and a right rainproof folding fan, each has a pivot at a bottom linked with the bearings of the rectangular frame, respectively. Two sets of Velcro is linked with the rectangular cover, the left rainproof folding fan and the right rainproof folding fan for forming the cover, wherein a coverage of the cover is adjustable by manipulating an angle of each the left rainproof folding fan or the right rainproof folding fan, respectively.

The two rod hinges is linked with the rectangular frame and attached onto two straps of a backpack through two fasteners, the each rod hinge having a bracket and a rod with a stopper and an outlet connected with the each pin respectively, wherein the cover and the two rod hinges form an umbrella with adjustable coverage which has the rectangular frame fixed with the stoppers when the cover is extended and the two rod hinges are extended and erected, as well as the right rainproof folding fan forms a normal used folding fan which has the right rainproof folding fan separated from the cover when the two rod hinges are retracted and the rectangular cover positioned upon the backpack.

DETAILED DESCRIPTION OF THE PREFERRED EMBODIMENTS

The present invention discloses an umbrella with adjustable coverage adapted to backpack, which can be fixed on the backpack without then holding umbrella. A coverage of the umbrella is adjustable via manipulating an angle of each a left rainproof folding fan or a right rainproof folding fan, respectively, suitable for rainy or sunny day. Each of the rainproof folding fans can be separated from the umbrella to form a normal used folding fan.

Embodiment 1

FIGS. 1-7 show aspects of an umbrella with adjustable coverage adapted to backpack in the embodiment 1 of the present invention.

Figure 1:
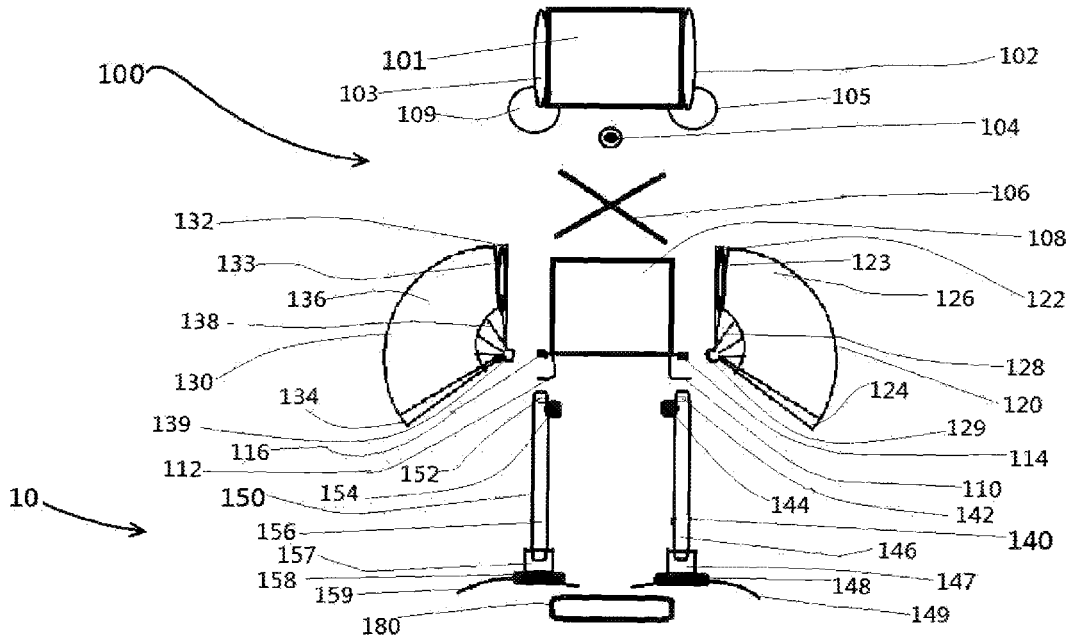
FIG. 1 is an exploded view of an umbrella with adjustable coverage adapted to backpack.

FIG. 1 is an exploded view of an umbrella with adjustable coverage adapted to backpack. As shown in FIG. 1, an umbrella 10 includes a cover 100 and two rod hinges 140, 150. The cover 100 includes a rectangular frame 108 with a left side and a right side, wherein the left side and the right side each comprises a pin 112, 110 and a bearing 116, 114, respectively. A canopy 101 is engaged with the rectangular frame 108 for forming a rectangular cover. A left side and a right side of the canopy 101 each has a Velcro's hook 103, 102 and two small sheets 109, 105.

The cover 100 further includes an X-frame 106, a knot 104, a left rainproof folding fan 130 and a right rainproof folding fan 120. The left rainproof folding fan 130 and the right rainproof folding fan 120 each has a pivot 139, 129 at a bottom for linking with the bearings 116, 114 of the rectangular frame 108, respectively. The left rainproof folding fan 130 includes a fan cloth 136, two fan handles 132, 134 and a plurality of ribs 138. The fan handle 132 has a Velcro's loop 133. The right rainproof folding fan 120 includes a fan cloth 126, two fan handles 122, 124 and a plurality of ribs 128. The fan handle 122 has a Velcro's loop 123. The Velcro's loop 133 and the Velcro's loop 123 are used for linking with the Velcro's hook 103, 102, respectively, and then the rectangular cover, the left rainproof folding fan 130 and the right rainproof folding fan 120 are linked to form the cover 100 there through. A coverage of the cover 100 is adjustable via manipulating an angle of each the left rainproof folding 130 or the right rainproof folding fan 120, respectively.

The two rod hinges 140, 150 each has a stand 157, 147 and a rod 156, 146. One end of each the rod 156, 146 have a stopper 154, 144 and an outlet 152, 142. The outlets 152, 142 are used for linking with the pins 112, 110 of the rectangular frame 108, respectively. Each the stand 156, 146 have a base 158, 148 and a fastener 159, 149. The rods 156, 146 can rotate up and down about the rod hinge 140, 150. The rods 156, 146 of the rod hinge 140, 150 can be fixed at any angle in the range of adjustable angles. A connecting bar 180 is an optional devise and is used to strengthen the connection of the two rod hinges 150, 140. The rectangular frame 108, the left rainproof folding fan 130 or the right rainproof folding fan 120 is formed with material selected from bamboo, titanium alloy or aluminum alloy.

Figure 2:
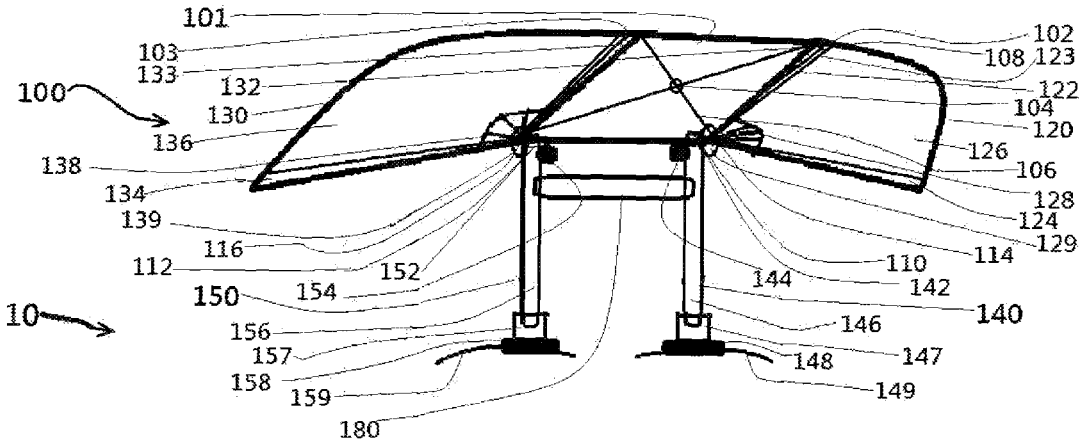
FIG. 2 is a perspective view of an umbrella with adjustable coverage adapted to backpack.

FIG. 2 is a perspective view of an umbrella with adjustable coverage adapted to backpack. As shown in FIG. 2, the umbrella 10 is formed via linking the cover 100 and two rod hinges 140, 150. One linking manner for forming the umbrella 10 is that the outlets 152, 142 are linked with the pins 112, 110 of the rectangular frame 108, respectively, and the connecting bar 180 is used to strengthen the linking. The cover 100 is formed via locating the X-frame 106 and the knot 104 into the rectangular frame 108, and engaging the rectangular frame 108 with the canopy 101, then linking the pivot 139, 129 with the bearings 116, 114 of the rectangular frame 108, as well as linking the Velcro's loop 133, 123 with the Velcro's hook 103, 102, respectively.

The cover 100 and the two rod hinges 140, 150 form the umbrella 10 with adjustable coverage which has the rectangular frame 108 fixed with the stoppers 154, 144 when the cover 100 is extended and the two rod hinges 140, 150 are extended and erected.

Figure 3:
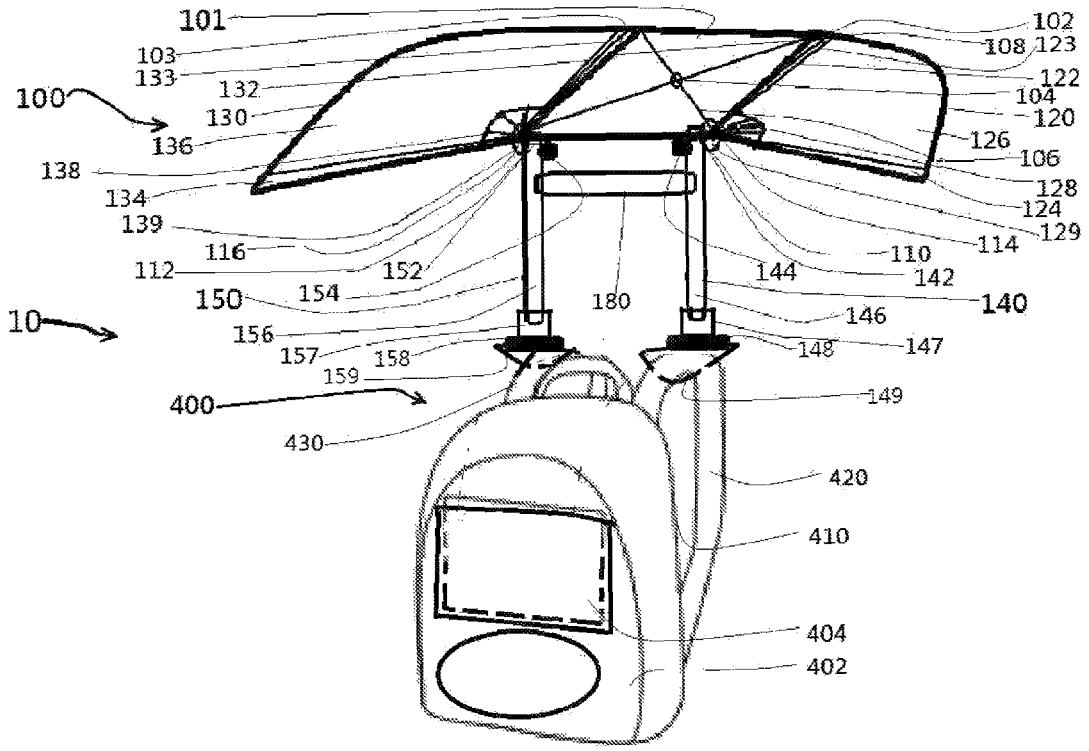
FIG. 3 is a perspective view of the umbrella in FIG. 2 combined to a backpack to form a normal used umbrella with adjustable coverage.

FIG. 3 is a perspective view of the umbrella in FIG. 2 combined to a backpack to form a normal used umbrella with adjustable coverage. As shown in FIG. 3, the two rod hinges 140, 150 of the umbrella 10 each attaches onto two straps 430, 420 of a backpack 400 via the fasteners 159, 149, respectively, and thus the umbrella 10 with adjustable coverage adapted to backpack 400 is formed. The backpack 400 is a classic backpack including a front 402 with a pouch 404 and a back 410 with the straps 430, 420.

Figure 4:
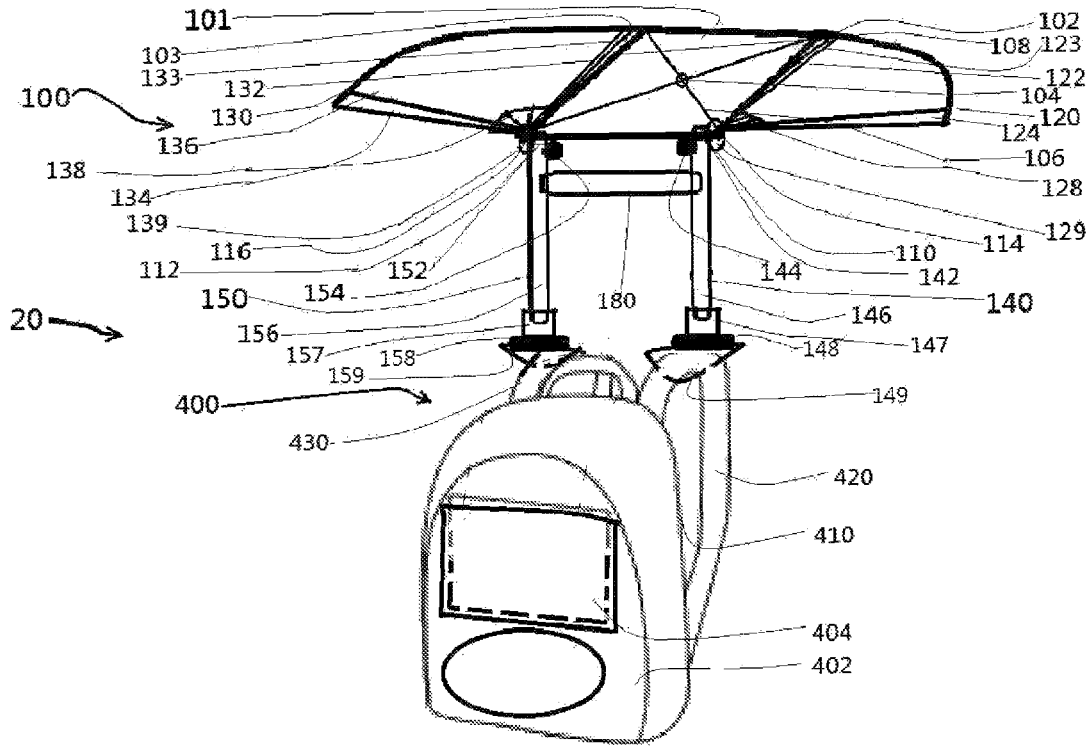
FIG. 4 is a perspective view of an umbrella with shrinkage coverage of the umbrella in FIG. 3.

FIG. 4 is a perspective view of an umbrella with shrinkage coverage of the umbrella in FIG. 3. As shown in FIG. 4, a coverage of the cover 100 is reduced via manipulating an angle of each the left rainproof folding fan 130 or the right rainproof folding fan 120, respectively, and thus the umbrella 20 with shrinkage coverage is formed. The fan handle 134 is used for manipulating an angle of the left rainproof folding fan 130. The fan handle 124 is used for manipulating an angle of the right rainproof folding fan 120.

Figure 5:
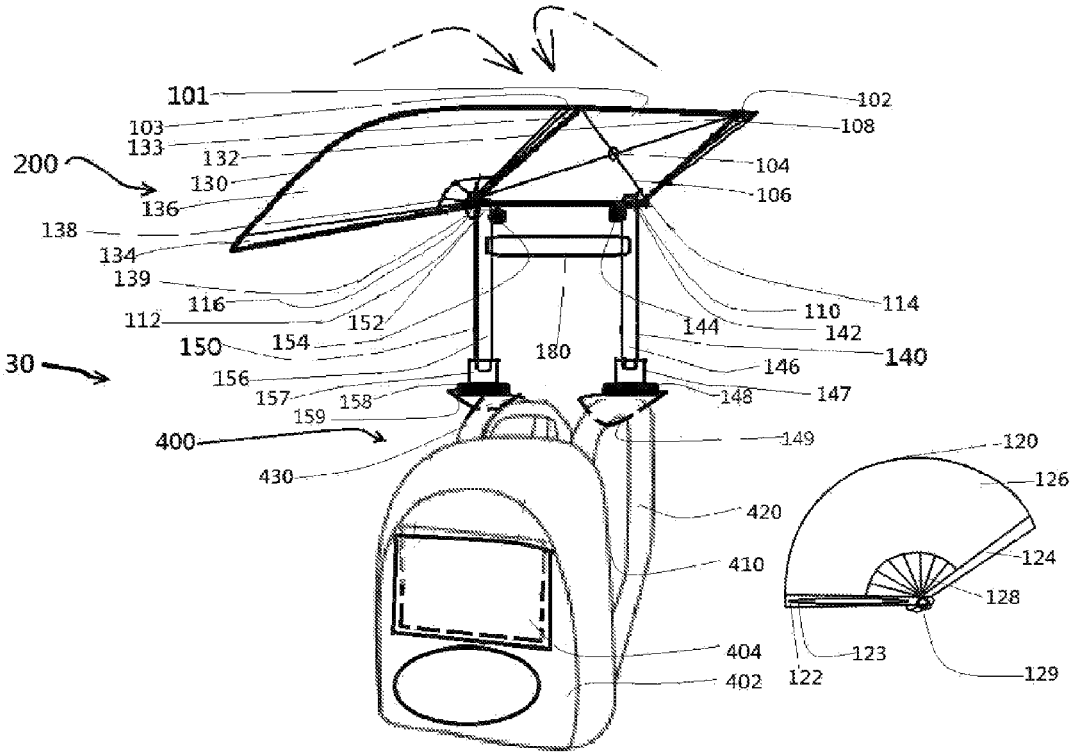
FIG. 5 is a perspective view of an umbrella with a normal used folding fan separated from the umbrella of FIG. 3.

FIG. 5 is a perspective view of an umbrella with a normal used folding fan separated from the umbrella of FIG. 3. As shown in FIG. 5, a cover 200 is formed by separating the right rainproof folding fan 120 from the cover 100, and thus an umbrella 30 with adjustable coverage adapted to backpack 400 is formed. The right rainproof folding fan 120 can be used as a normal used folding. Two arrows on the top of FIG. 5 indicate a manipulating approach to close the umbrella 30.

Figure 6:
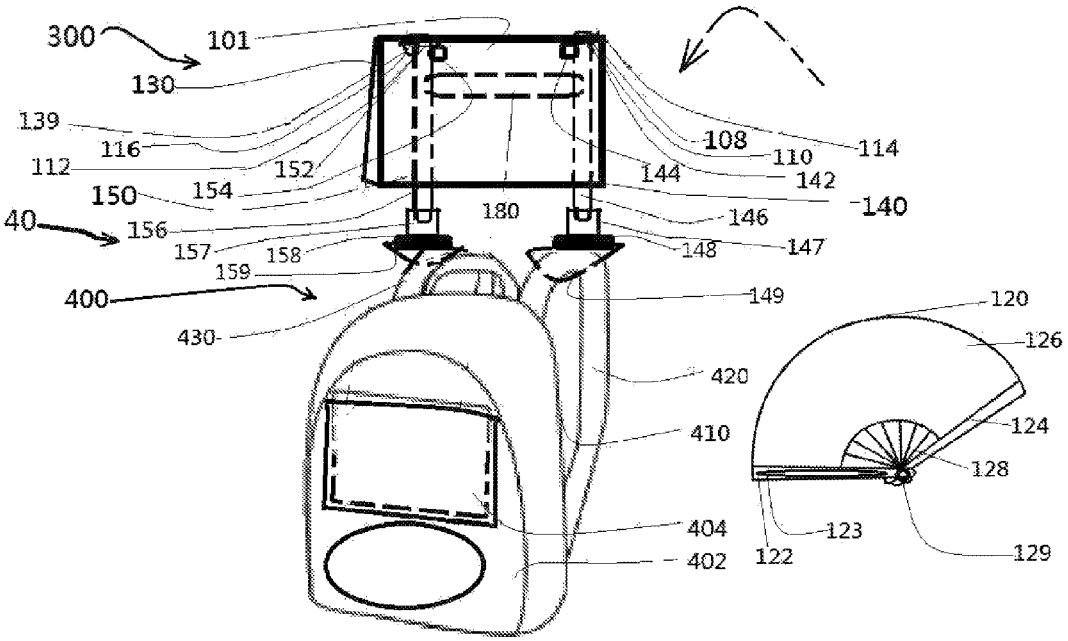
FIG. 6 is a perspective view of an umbrella at a closing status of the umbrella in FIG. 5.

FIG. 6 is a perspective view of an umbrella at a closing status of the umbrella in FIG. 5. As shown in FIG. 6, a cover 300 is formed by closing the left rainproof folding fan 130 and turning back the cover 200 according to the indication of the two arrows in FIG. 5, and thus an umbrella 40 at a closing status is formed. One arrow on the right of FIG. 6 indicates a manipulating approach to turn down the umbrella 40.

Figure 7:
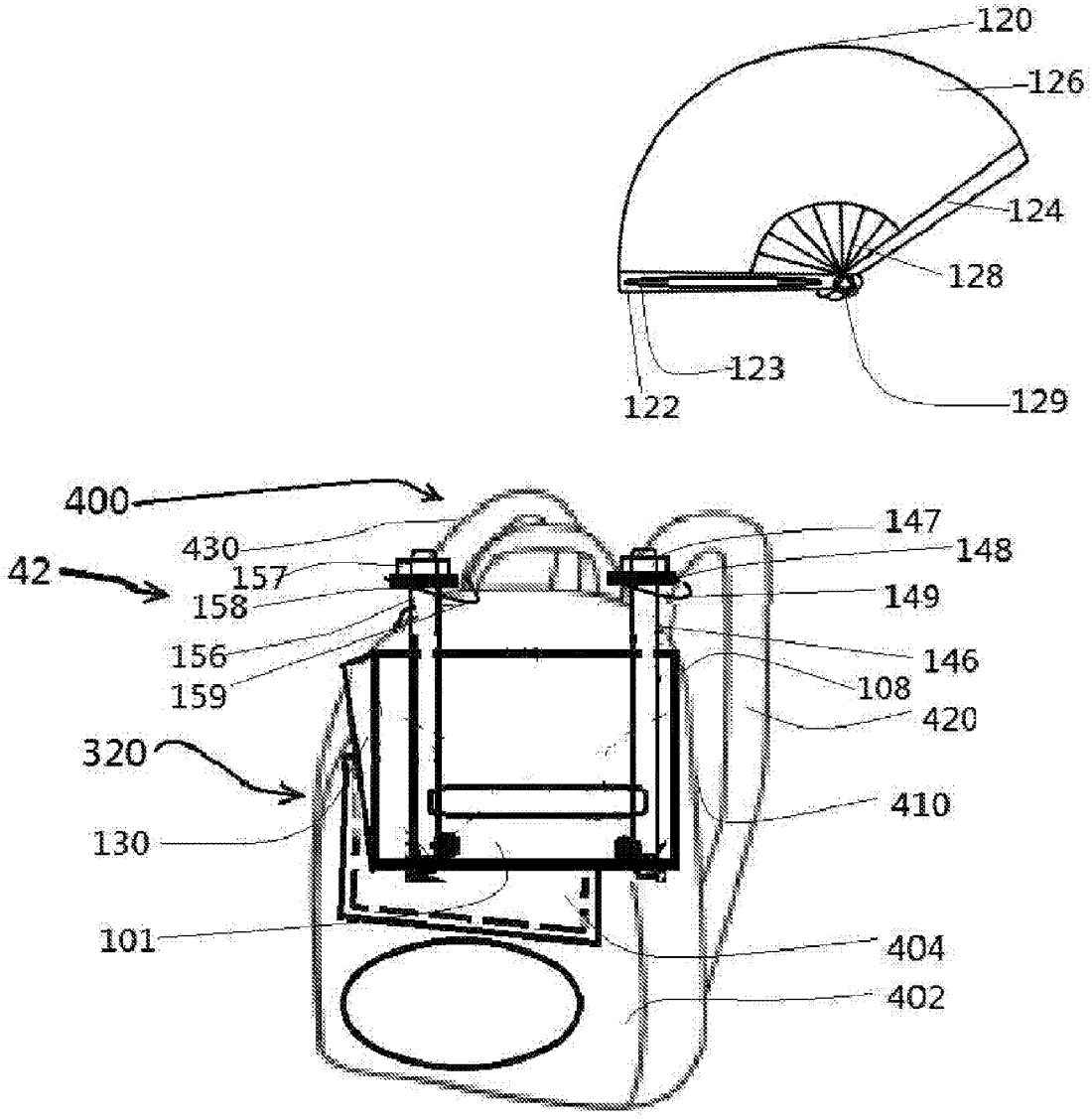
FIG. 7 is a perspective view of an umbrella closed and positioned upon the backpack of the umbrella in FIG. 6.

FIG. 7 is a perspective view of an umbrella closed and positioned upon the backpack of the umbrella in FIG. 6. As shown in FIG. 7, an umbrella 42 with a cover 320 is formed by turning down the umbrella 40 and retracting the two rod hinges 140, 150 according to the indication of the arrow in FIG. 6, and thus the umbrella 42 is positioned upon the backpack 400. The right rainproof folding fan 120 can be used as a normal used folding.

Embodiment 2

FIGS. 8-13 show aspects of an umbrella with adjustable coverage adapted to backpack in the embodiment 2 of the present invention.

Figure 8:
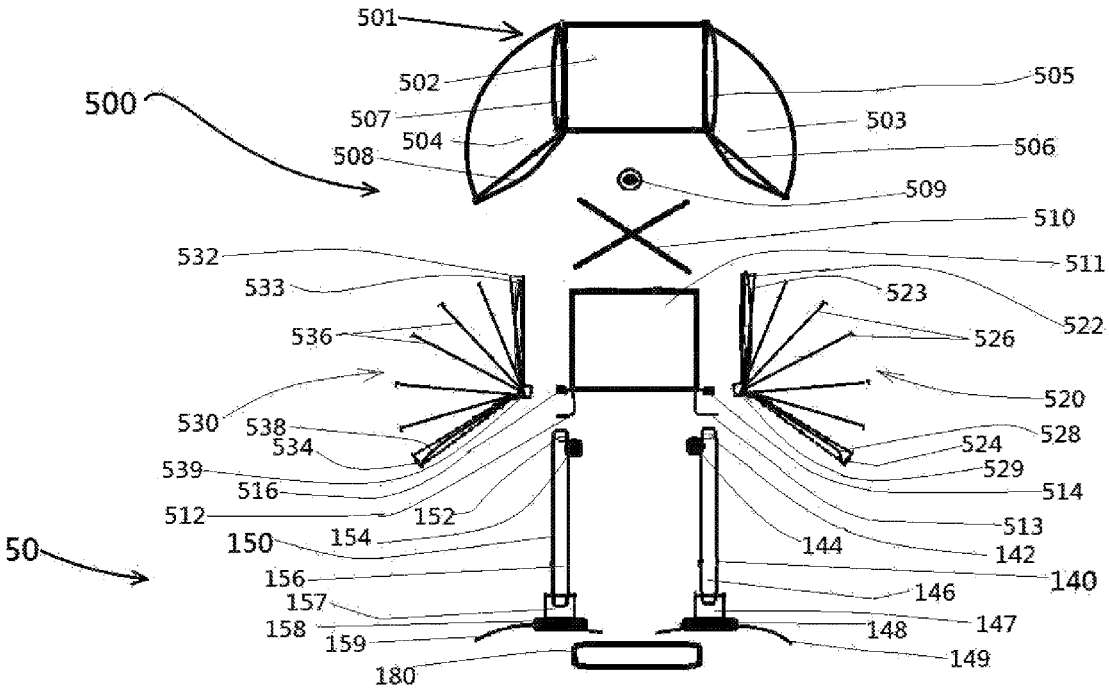
FIG. 8 is an exploded view of an umbrella with adjustable coverage adapted to backpack in the embodiment 2.

FIG. 8 is an exploded view of an umbrella with adjustable coverage adapted to backpack in the embodiment 2. As shown in FIG. 8, an umbrella 50 includes a cover 500 and two rod hinges 140, 150. The cover 500 includes a rectangular frame 511 with a left side and a right side, wherein the left side and the right side each comprises a pin 512, 513 and a bearing 516, 514, respectively. A canopy 501 includes rectangular cloth 502, a left folding cloth 504 and a right folding cloth 503. The left folding cloth 504 has two Velcro's hooks 507, 508. The right folding cloth 503 has two Velcro's hooks 505, 506.

The cover 500 further includes an X-frame 510, a knot 509, a left folding frame 530 and a right folding frame 520. The left folding frame 530 and the right folding frame 520 each has a pivot 539, 529 at a bottom for linking with the bearings 516, 514 of the rectangular frame 511, respectively. The left folding frame 530 includes two fan handles 532, 534 and a plurality of ribs 536. The fan handle 532 has a Velcro's loop 533. The fan handle 534 has a Velcro's loop 538. The right folding frame 520 includes two fan handles 522, 524 and a plurality of ribs 526. The fan handle 522 has a Velcro's loop 523. The fan handle 524 has a Velcro's loop 528. The Velcro's loop 533 and the Velcro's loop 523 are used for linking with the Velcro's hook 507, 505, respectively. The Velcro's loop 538 and the Velcro's loop 528 are used for linking with the Velcro's hook 508, 506, respectively. Then, the cover 501, rectangular frame 511, the left folding frame 530 and the right folding frame 520 are linked to form the cover 500 there through. A coverage of the cover 500 is adjustable via manipulating an angle of each the left folding frame 530 or the right folding frame 520, respectively.

The two rod hinges 140, 150 of the umbrella 50 each has a stand 157, 147 and a rod 156, 146. One end of each the rod 156, 146 have a stopper 154, 144 and an outlet 152, 142. The outlets 152, 142 are used for linking with the pins 512, 513 of the rectangular frame 511, respectively. Each the stand 156, 146 have a base 158, 148 and a fastener 159, 149. The rods 156, 146 of the rod hinge 140, 150 can be fixed at any angle in the range of adjustable angles. A connecting bar 180 is an optional devise and is used to strengthen the connection of the two rod hinges 150, 140. The rectangular frame 511, the left folding frame 530 or the right folding frame 520 is formed with material selected from bamboo, titanium alloy or aluminum alloy.

Figure 9:
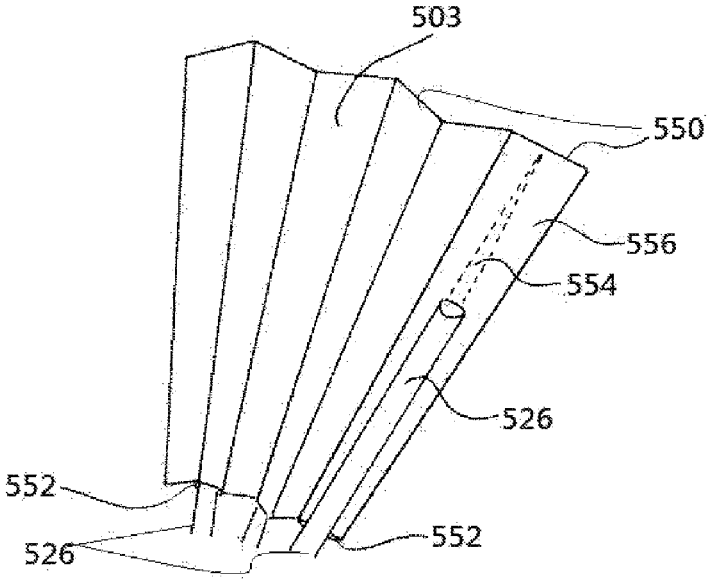
FIG. 9 is a perspective view of a folding fan structure.

FIG. 9 is a perspective view of a folding fan structure. As shown in FIG. 9, one part of the right folding cloth 503 in FIG. 8 includes a plurality of cloths 550. The each cloth 550 has an opening 552, a groove 554 and a surface 556. A folding fan structure is formed via inserting the ribs 526 through openings 552 and into the grooves 554.

Figure 10:
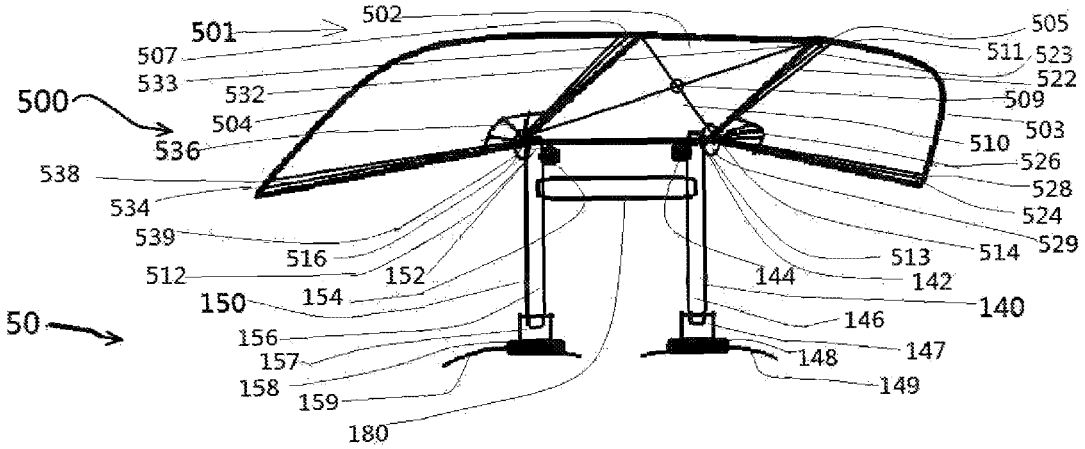
FIG. 10 is a perspective view of an umbrella with adjustable coverage adapted to backpack in the embodiment 2.

FIG. 10 is a perspective view of an umbrella with adjustable coverage adapted to backpack in the embodiment 2. As shown in FIG. 10, the umbrella 50 is formed via linking the cover 500 and two rod hinges 140, 150. One linking manner for forming the umbrella 50 is that the outlets 152, 142 are linked with the pins 512, 513 of the rectangular frame 511, respectively, and the connecting bar 180 is used to strengthen the linking. The cover 500 is formed via locating the X-frame 510 and the knot 509 into the rectangular frame 511, and engaging the rectangular frame 511, the left folding frame 530 and the right folding frame 520 with the canopy 101, then linking the pivot 539, 529 with the bearings 516, 514 of the rectangular frame 511, as well as linking the Velcro's loop 533, 523, 538, 528 with the Velcro's hook 507, 505, 508, 506, respectively.

The cover 500 and the two rod hinges 140, 150 form the umbrella 50 with adjustable coverage which has the rectangular frame 511 fixed with the stoppers 154, 144 when the cover 500 is extended and the two rod hinges 140, 150 are extended and erected.

Figure 11:
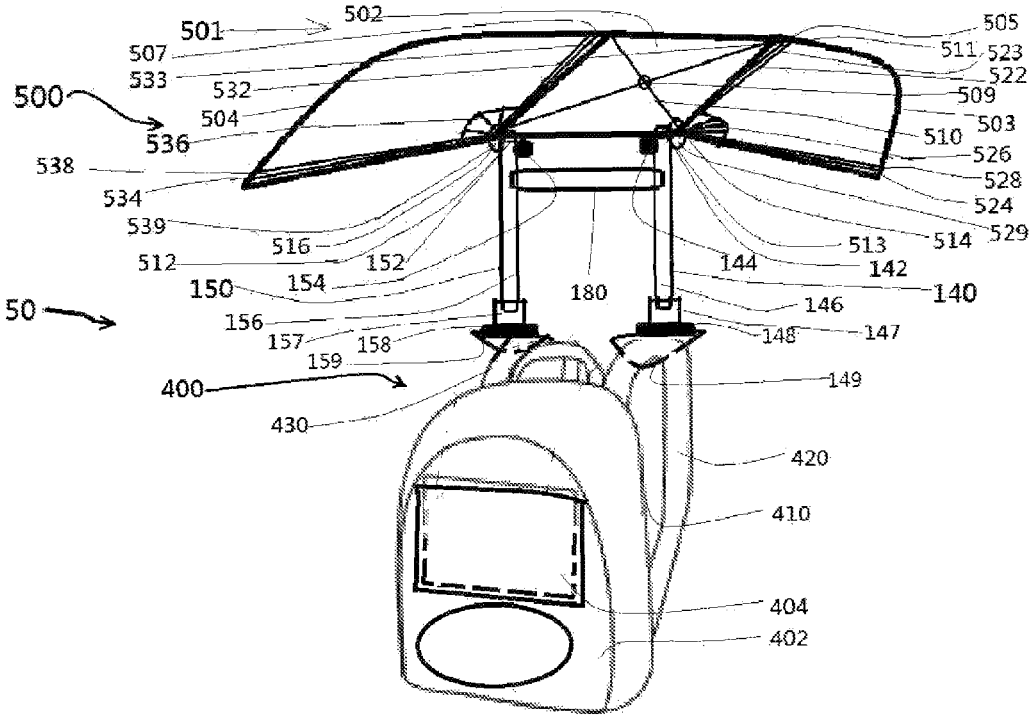
FIG. 11 is a perspective view of the umbrella in FIG. 10 combined to a backpack to form a normal used umbrella with adjustable coverage.

FIG. 11 is a perspective view of the umbrella in FIG. 10 combined to a backpack to form a normal used umbrella with adjustable coverage. As shown in FIG. 11, the two rod hinges 140, 150 of the umbrella 50 each attaches onto two straps 430, 420 of a backpack 400 via the fasteners 159, 149, respectively, and thus the umbrella 50 with adjustable coverage adapted to backpack 400 is formed.

Figure 12:
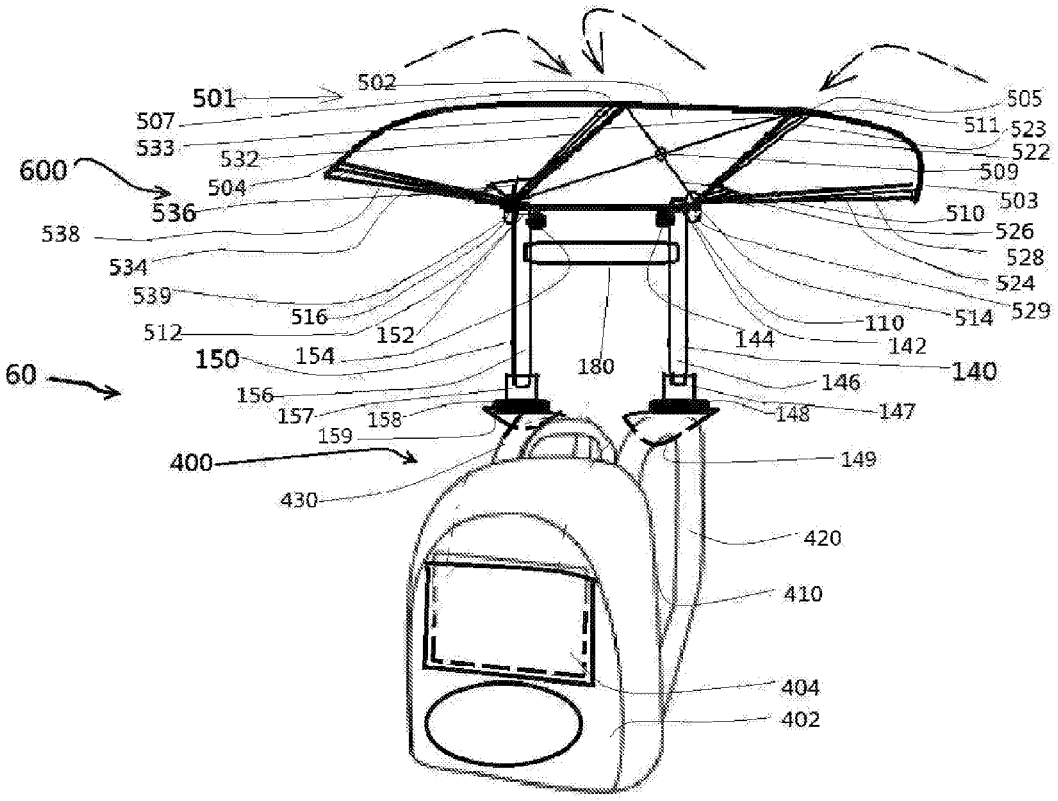
FIG. 12 is a perspective view of an umbrella with shrinkage coverage of the umbrella in FIG. 11.

FIG. 12 is a perspective view of an umbrella with shrinkage coverage of the umbrella in FIG. 11. As shown in FIG. 12, a coverage of the cover 100 is reduced via manipulating an angle of each the left folding frame 530 or the right folding frame 520, respectively, and thus the umbrella 60 with shrinkage coverage is formed. The fan handle 534 is used for manipulating an angle of the left folding frame 530. The fan handle 524 is used for manipulating an angle of the right folding frame 520. Three arrows on the top of FIG. 12 indicate a manipulating approach to close and turn down the umbrella 60.

Figure 13:
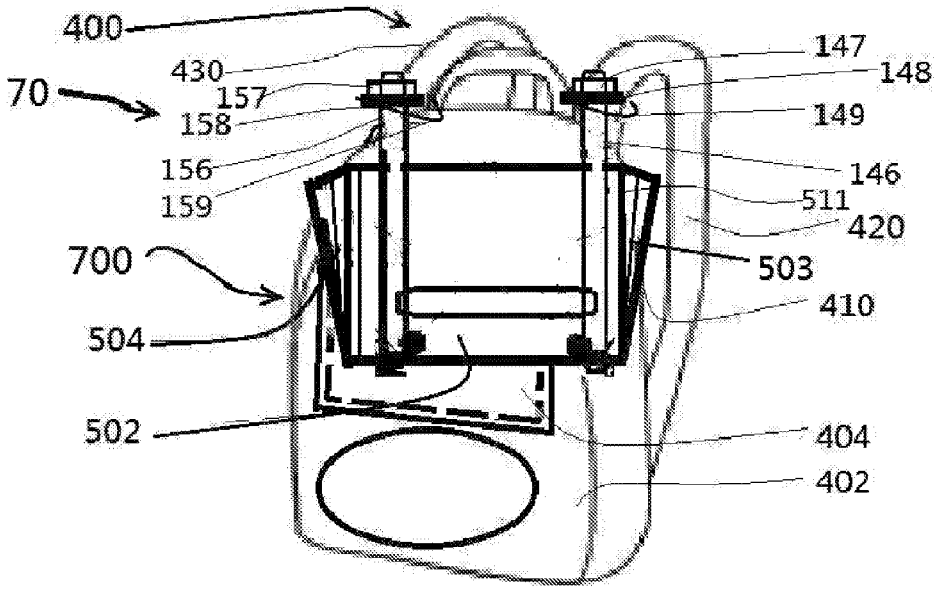
FIG. 13 is a perspective view of an umbrella closed and positioned upon the backpack of the umbrella in FIG. 12.

FIG. 13 is a perspective view of an umbrella closed and positioned upon the backpack of the umbrella in FIG. 12. As shown in FIG. 13, an umbrella 70 at a closing status can be used as a protective shell 70 for the backpack 400.

The protective shell 70 is formed by closing the left folding frame 530 and the right folding frame 520, then turning down the umbrella 70 and retracting the two rod hinges 140, 150 according to the indication of the arrows in FIG. 12 and thus the umbrella 70 is positioned upon the backpack 400 and can be used as the protective shell 70.

Compared to traditional umbrellas or an umbrella adapted to backpack, the present invention has several advantages. First, the embodiments enable an umbrella with adjustable coverage adapted to backpack by using simple structure, wherein a coverage of the umbrella is adjustable via the use of folding fan structure. Second, the umbrella shape of the present invention is a new shape. Ergonomically, both sides of the umbrella with a large coverage can shield the both shoulders of the body. Additionally, a rainproof folding fan can be separated from the umbrella to form a normal used folding fan. Finally, after using this umbrella several times, a user can open and close the umbrella without removing the backpack.

What is claimed is:

1. An umbrella with adjustable coverage adapted to backpack, comprising:

a rectangular frame, having a left side and a right side, wherein the left side and the right side each comprises a pin and a bearing, respectively;

a canopy engaged with the rectangular frame for forming a rectangular cover;

a left rainproof folding fan and a right rainproof folding fan, each having an pivot at a bottom linked with the bearings of the rectangular frame, respectively;

two sets of Velcro, for linking with the rectangular cover, the left rainproof folding fan and the right rainproof folding fan for forming a cover, wherein a coverage of the cover is adjustable by manipulating an angle of each the left rainproof folding fan or the right rainproof folding fan, respectively; and two rod hinges linked with the rectangular frame and attached onto two straps of a backpack through two fasteners, the each rod hinge having a bracket and a rod with a stopper and an outlet connected with the each pin respectively, wherein the cover and the two rod hinges form an umbrella with adjustable coverage which has the rectangular frame fixed with the stoppers when the cover is extended and the two rod hinges are extended and erected, as well as the right rainproof folding fan forms a normal used folding fan which has the right rainproof folding fan separated from the cover when the two rod hinges are retracted and the rectangular cover positioned upon the backpack.

2. The umbrella as recited in claim 1, wherein the rectangular frame comprises an X-frame and a knot.

3. The umbrella as recited in claim 1, wherein the rod of the rod hinge can be fixed at any angle in the range of adjustable angles.

4. The umbrella as recited in claim 1, wherein the rectangular frame, the left rainproof folding fan or the right rainproof folding fan is formed with material selected from bamboo, titanium alloy or aluminum alloy.

5. The umbrella as recited in claim 1, further comprising a connecting bar used to connect the two rod hinges.

6. An umbrella with adjustable coverage adapted to backpack, comprising:

a rectangular frame linked with a left folding frame and a right folding frame, wherein a left side and a right side of the rectangular frame each comprises a pin, as well as the left folding frame and the right folding frame each comprises a plurality of ribs, respectively;

a canopy engaged with the rectangular frame the left folding frame and the right folding frame for forming a cover, wherein a coverage of the cover is adjustable by manipulating an angle of each the left folding frame or the right folding frame, respectively; and two rod hinges linked with the rectangular frame and attached onto two straps of a backpack through two fasteners, the each rod hinge having a bracket and a rod with a stopper and an outlet connected with the each pin respectively, wherein the cover and the two rod hinges form an umbrella with adjustable coverage which has the rectangular frame fixed with the stoppers when the cover is extended and the two rod hinges are extended and erected, as well as the cover and the two rod hinges form a protective shell when the two rod hinges are retracted and the cover positioned upon the backpack.

7. The umbrella as recited in claim 6, wherein the rectangular frame comprises an X-frame and a knot.

8. The umbrella as recited in claim 6, wherein the rod of the rod hinge can be fixed at any angle in the range of adjustable angles.

9. The umbrella as recited in claim 6, wherein the rectangular frame and the ribs of the right folding frame, the left folding frame or the right folding frame is formed with material selected from bamboo, titanium alloy or aluminum alloy.

10. The umbrella as recited in claim 6, further comprising a connecting bar used to connect the two rod hinges.

* * * * *